United States Patent [19]

Thompson

[11] Patent Number: 4,647,877

[45] Date of Patent: Mar. 3, 1987

[54] BROADBAND SIGNAL TERMINATION APPARATUS COMPRISING SERIES CASCADE OF RESISTORS AND TRANSMISSION LINES

[75] Inventor: William J. Thompson, Richardson, Tex.

[73] Assignee: Rockwell International Corporation, El Segundo, Calif.

[21] Appl. No.: 710,736

[22] Filed: Mar. 11, 1985

[51] Int. Cl.[4] ..... H01P 1/26

[52] U.S. Cl. ..... 333/22 R; 333/24.2; 338/307; 338/308; 338/320; 338/216

[58] Field of Search ..... 333/22 R, 81 A, 246, 333/238, 24.2; 357/51; 338/216, 254, 260, 307, 308, 311, 314, 319, 320

[56] References Cited

U.S. PATENT DOCUMENTS 2,438,915 4/1948 Hansen ..... 333/22 R
3,441,804 4/1969 Klemmer ..... 338/308
4,024,478 5/1977 Wolfe ..... 333/22 R X
4,034,321 7/1977 Ward, Jr. et al. ..... 333/34 X

*Primary Examiner*—Eugene R. LaRoche
*Assistant Examiner*—Benny Lee
*Attorney, Agent, or Firm*—Bruce C. Lutz; V. L. Sewell; H. Fredrick Hamann

[57] ABSTRACT

A signal termination device is illustrated using planar circuit technology for providing both broadband capabilities from DC to over ten gigahertz while maintaining small size and high power dissipation capabilities. This is accomplished by plating a series cascade of resistors and transmission lines such that the sum of the resistors is equal to the desired termination impedance and the impedance of the interconnecting transmission lines is equal to the sum of the remaining resistors between that point and ground. The use of the intervening transmission lines enhances the power handling capability of the resistor elements and enhances uniform power densities in the resistor elements.

11 Claims, 3 Drawing Figures

BROADBAND SIGNAL TERMINATION APPARATUS COMPRISING SERIES CASCADE OF RESISTORS AND TRANSMISSION LINES

THE INVENTION

The present invention is generally related to electronics and more specifically related to signal termination devices. Even more specifically, the device is related to a planar circuit construction type terminating device having broadband frequency capabilities from DC to over ten gigahertz.

BACKGROUND

Prior art high frequency terminating devices are available in a wide assortment of styles and shapes but most of these have deficiencies either in the frequency range, the power handling capability or in ability to be used with planar waveguide technology. One of the better prior art terminating devices for coaxial cable is illustrated by a patent to Hanson, U.S. Pat. No. 2,438,915, issued Apr. 6, 1947. This uses the concept of milling or otherwise forming a device which continuously varies the gap between ground and the conductive element. This device has high power capabilities and a wide frequency range. However, it is not easily adaptable to microstrip technology and compared with microstrip technology, can be very expensive to manufacture.

The present invention can be mass produced using standard thin and thick film circuit manufacturing techniques. By using a series cascade of resistive elements and connecting transmission lines where the sum of the resistance of the resistive elements is equal to the desired termination impedance and the impedance of any given interconnecting transmission line is equal to the sum of the remaining resistive elements, a terminating device is obtainable which operates from DC to frequencies in excess of ten gigahertz.

It is thus an object of the present invention to provide an improved termination device utilizing present day manufacturing technology.

Other advantages and objects of the present inventive concept may be ascertained from a reading of the specification and appended claims in conjunction with the drawings wherein:

DETAILED DESCRIPTION

Figure 1:
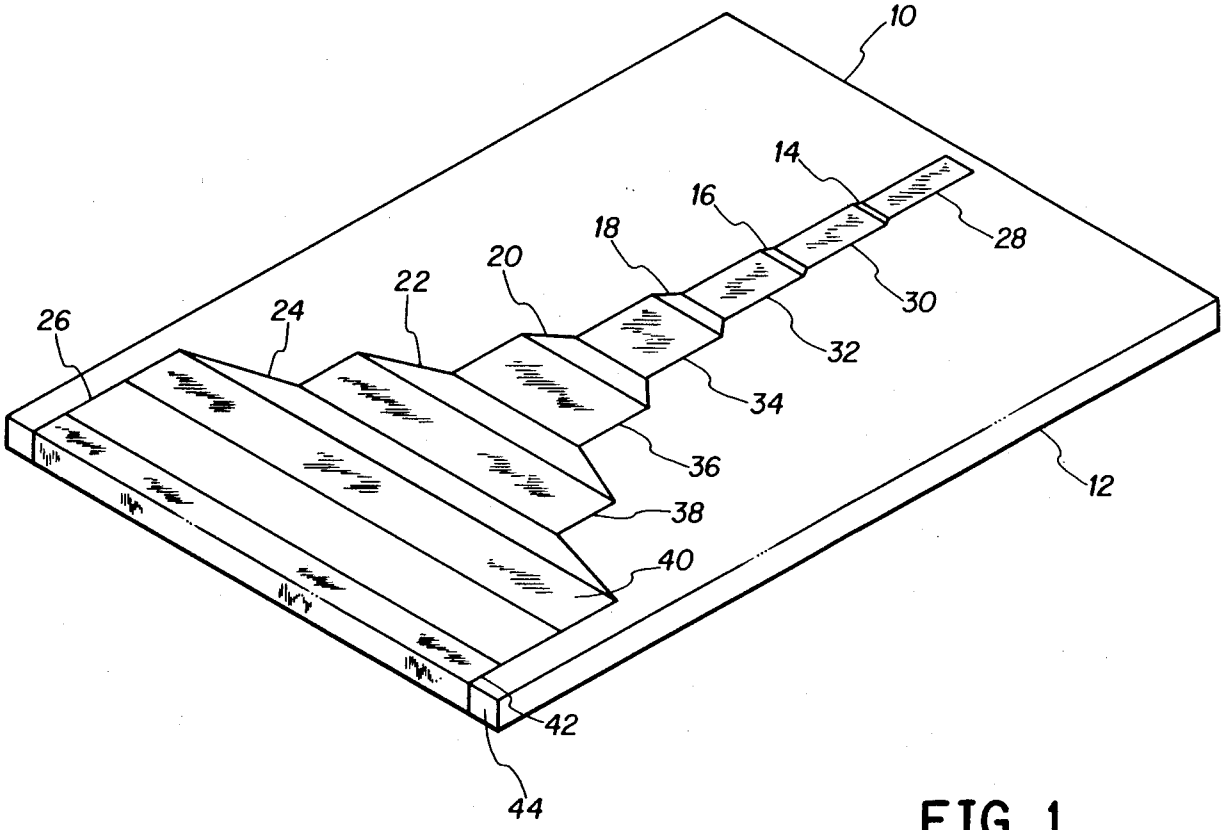
FIG. 1 is an isometric drawing of one embodiment of the inventive concept.

In FIG. 1 a substrate comprising a slice of alumina or other apropriate material 10 is illustrated with a back plane or underside layer of grounding material not shown but designated as 12. On the illustrated side opposite the back plane 12 is a structure comprising a series of resistors and transmission elements. As illustrated, there are resistive elements 14, 16, 18, 20, 22, 24 and 26. The remaining elements are conductors having apparent transmission line impedance deterined by their width and the distance of separation from ground plane 12. These conductors or transmission lines are designated as 28, 30, 32, 34, 36, 38, 40 and 42. As will be noted, transmission line 42 wraps around an end 44 of the substrate 10 so as to be connected to the ground plane 12 on the opposite side.

In one embodiment of the invention, the resistor elements 14, 16 and 24 were five ohms, the element 18 was six ohms, the element 20 was nine ohms, the elements 22 and 26 were ten ohms. The transmission line 28 started out at 50 ohms and the increased width transmission line 30 was 45 ohms. The further increased width transmission line 32 was 40 ohms and the transmission line 34 was 34 ohms. The additional nine ohms of resistor 20 required transmission line 36 to be 25 ohms and the additional resistance of resistor 22 required the transmission line 38 to be fifteen ohms. The resistance of resistor 24 requires that the transmission line 40 be ten ohms since the transmission line needs to be the same apparent impedance as the remaining resistors between it and ground. As is known to those skilled in the art, the apparent impedance of a transmission line is related to the width of the transmission line (i.e., wider lines=-lower impedances) for a fixed ground plane spacing. Thus, the final conductor 42 should have infinite width to have zero impedance since there are no more resistors between it and ground 12. This width is impractical on a working device and thus, a compromise must be made for this final connection because of difficulties in providing an accurate, resistive element around the end of a substrate in a production environment. Thus, there is a mismatch of very low order in not having the transmission line or conductor 42 be infinitely wide between the edge of resistor 26 and the connection to ground 12. It is desirable that the final conductor 42 be kept as short as possible to minimize the mismatch associated with its non-zero impedance.

The embodiment of the invention illustrated used a substrate having a thickness of 0.025 inches and the resistor element 14 varied from 0.022 inches in width to 0.027 inches in width and was 0.0020 inches long. The transmission line 30 separating resistor 14 from resistor 16 was 0.038 inches in length and was thus approximately one and a half times as long as the thickness of the substrate material 10. The final resistor 26 was 0.25 inches wide and was 0.05 inches in length.

Figure 2:
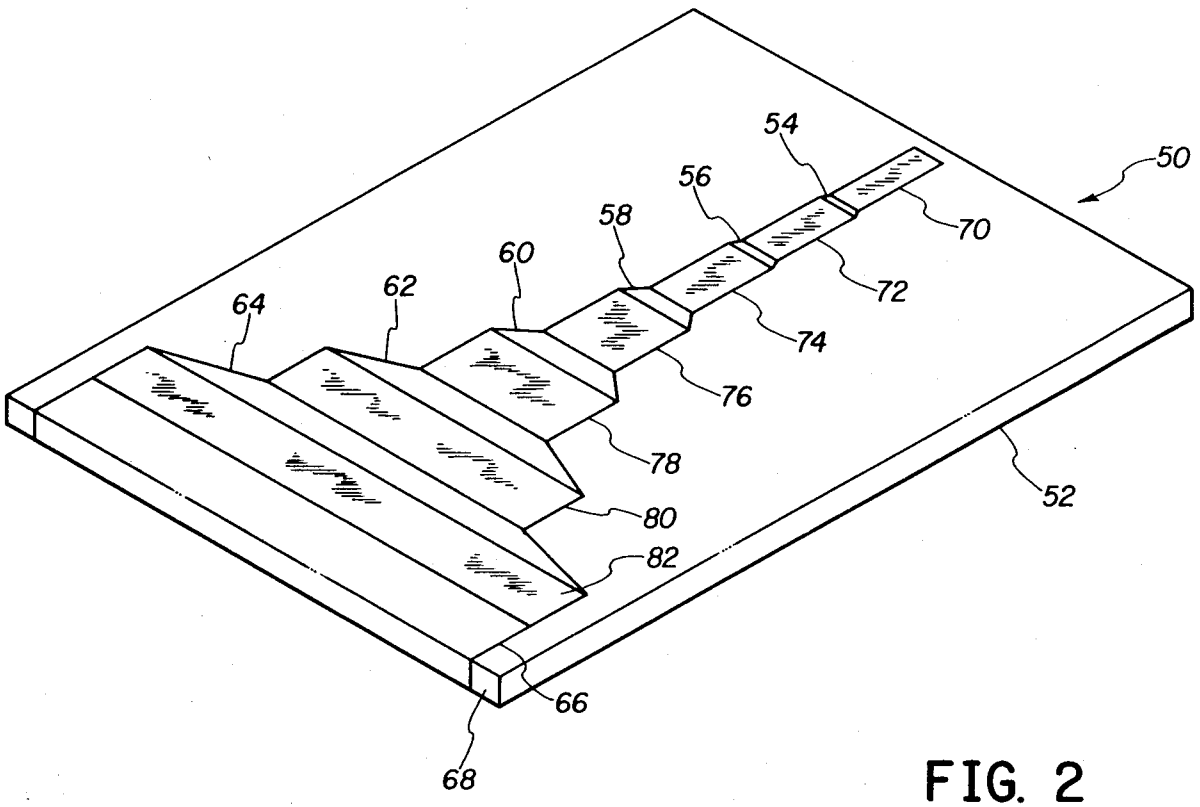
FIG. 2 is an isometric drawing of a second embodiment of the inventive concept.

FIG. 2 is a terminating device similar to that shown in FIG. 1. As illustrated, the substrate material is designated as 50 with the back plane 52 and the device contains a plurality of resistors 54, 56, 58, 60, 62, 64 and 66. Resistor 66 wraps around an end 68 of the substrate material 50. This embodiment gives an improved impedance match relative to the configuration of FIG. 1 because the length of the final conductor (corresponding to element 42 of FIG. 1) has been reduced to zero. There are conductors or transmission line elements 7, 72, 74, 76, 78, 80 and 82 connecting the resistive elements, as illustrated, in a manner very similar to that of FIG. 1. While such a device, as shown in FIG. 2, can be achieved under laboratory conditions and under some production processes, it is, as mentioned above, very difficult to achieve a close tolerance resistive value around the edge of the board and still maintain economical production of such a terminating device.

Figure 3:
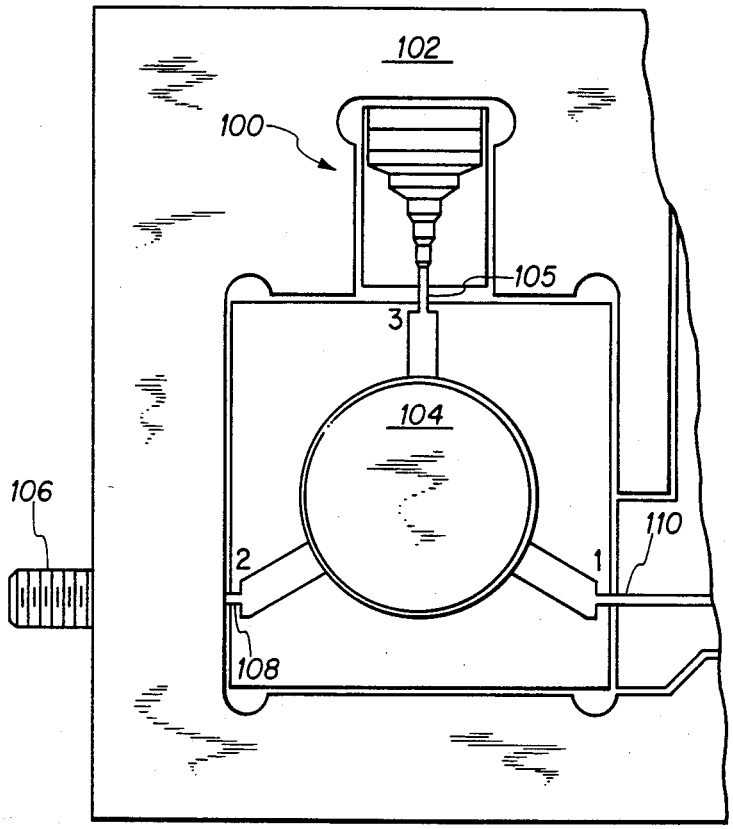
FIG. 3 is a top view of a portion of a product incorporating the product of the present invention as a terminating device for a circulator in a circuit application.

In FIG. 3 a cut away view is shown of a circuit portion in housing 102 including a terminating device 100 mounted in a cavity of the housing. Also shown is a circulator means 104 having ports 1, 2 and 3 labeled in standard circulator terminology. The ports 1, 2 and 3 each have a fifty ohm impedance. Although these ports are shown as being wider than a connection 105 to the terminating device 100, an output port 106 and its microstrip connection 108 or an input microstrip 110, they are matched because the microstrip transmission lines are each also fifty ohms and there is only a slight discontinuity at the interface. As the terminating device 100 is used in a practical embodiment, the circulator 104 in combination with terminating device 100 produces the effect of an isolator whereby signals are passed from port 1 to 2 but any undesirable reflected signals are grounded through terminating device 100 to ground rather than being returned to the source of signals connected to microstrip transmission line 110.

OPERATION

From the information presented supra, it is believed reasonably obvious how the terminating device works but a brief summary will be provided anyway.

When any transmission line is terminated, the impedance of the termination device must exactly equal the apparent impedance of the transmission line, otherwise, the mismatch will cause reflection signals thereby introducing standing waves and associated problems with other circuitry generating or using signals on the transmission line.

While a single resistor may well be used to terminate a transmission line, if it is to have a good broadband DC to high frequency match, its dimensions must be small compared to the wavelength of the signal at the highest frequency. This requires that the single resistor be small physically thus reducing its power dissipation ability. The power dissipation ability of a deposited resistor (thick or thin film) is in proportion to its area and somewhat to its periphery (i.e., small resistors=small power capability).

Separate chip resistors are a poor choice since the heat sink is normally the ground conductor of the substrate and the chip resistor has greater thermal resistance to the heat sink (less heat dissipating capability). The present accepted approach to the problem is to use separate coaxial terminations similar to the referenced Hanson patent for high power broadband applications. The present device did not burn out in one embodiment until it had reached a total power dissipation of forty two watts. Thus, it can easily be expected to handle ten to twenty watts in normal usage and with optimization of resistor values and/or increased numbers of resistor elements could be conservatively rated at much higher power levels with substantially no increase in physical size.

As will be noted, each of the resistors other than resistor 26 is trapezoidal so as to gradually prepare the signal for the next width transmission line. If a sharp transition or discontinuity in signal path is used, there is a high probability of signal reflections.

A further advantageous use for the transmission lines not cited, supra, is that they help distribute the current throughout the width of the transmission line for application to the next resistive element. In other words, if the transmission lines such as 32 were very short, the power density in resistive element 18 might not be uniform across the input portion connected to transmission element 32 and it would be likely that there would be even more non-uniformity in the power distribution at the point of connection to transmission line 34.

Another prior art method of terminating a microstrip circuit comprises a tapered termination resistive element which is long compared to the wavelength which slowly dissipates the RF energy without introducing significant reflections. However, these terminating devices are physically large and do not work at direct current frequencies.

The terminating device of this invention comprises a series cascade of resistors and transmission lines such that the sum of resistors 14 and 26 are exactly equal to the impedance of the transmission line 28 and the transmission line to which line 28 is connected. As previously indicated, one embodiment of the invention was used to terminate a fifty ohm impedance transmission line and thus, the sum of resistors 14 through 26 equaled exactly fifty ohms. By spacing the resistors a distance apart of at least the thickness of the substrate 10 and preferably at least two thicknesses apart, the power dissipation of the device is enhanced enormously. The further the resistance elements are apart, the lower the temprature rise will be in a given element because the power dissipation is more easily transmitted to ground plane 12 for a heat sink dispersion of the power. It is further desirable that the first few resistors be fairly small resistance increments since the narrow width introduces a large power dissipation density. At each transmission line segment of the terminating device, the impedance of that segment should equal the sum of the remaining resistors between that device and the connection to ground plane 12. The exact resistor values and transmission line links are relatively unimportant as long as there is adequate power dissipation and as long as the totals of the resistance values always equal the impedance of the transmission line immediately preceding that set of resistance values.

Although the device is shown in microstrip format, the invention can as readily be practiced in stripline (two ground planes) technology. Further, although the device is shown for terminating a microstrip device in FIG. 3, the terminating device illustrated can easily be packaged in such a way that it can be used to terminate coaxial cable. The advantage of using this for terminating coaxial cable is, of course, the repeatability of product as well as economy of production. As will be noticed, the terminating device in FIG. 3 uses six resistors whereas the terminating device of FIGS. 1 and 2 being later versions are seven resistors, the principle is still the same of having a given transmission line element have the same impedance as the sum of the remaining resistors between that element and ground. Further, FIG. 3 practices separating the resistive elements so that a major portion of the power dissipation is conducted through the substrate material to ground as a heat sink.

Although I have illustrated a microstrip version of the application, I wish not to be limited by the embodiment specifically shown but rather by the scope of the appended claims wherein I claim:

1. The method of terminating a microstrip transmission line comprising, the steps of:

depositing a series cascade of resistance elements and intermediate transmission lines on a substrate where the impedance of successive resistance elements generally do not decrease in absolute value and the impedance of the intermediate transmission lines decrease by an amount similar to the value of the adjacent resistance element to minimize the amount of mismatch and associated signal reflections; and connecting the final resistance element to ground with a minimim length conductive element.

2. High power signal transmission line termination means with minimum signal reflection over a wide frequency band starting at DC comprising, in combination:

a plurality of resistive elements with each resistive element dissipating a portion of the power associated with signals flowing therethrough; and a plurality of transmission line elements, individual line elements intermediate individual ones of said plurality of discrete resistive elements whereby the line impedance of each consecutive transmission line element is less than the next previous transmission line element by the amount of the adjacent resistive element.

3. Transmission line terminating apparatus comprising, in combination:

substrate first means including ground plane means;

second means on the surface of said first means for connection to a transmission line to be terminated;

a plurality of resistive element third means attached to the surface of said first means; and a plurality of transmission line element fourth means attached to the surface of said third means interconnecting said third means in series between said second means and said ground plane means, the nominal impedance of an individual one of said transmission line element fourth means being substantially equal to the sum of the resistances of the remaining resistive element third means between that one of said transmission line element fourth means and said ground plane means.

4. The method of wide band terminating a transmission line in a microstrip circuit comprising, the steps of:

series connecting a plurality of resistive element means each with intermediate transmission line means, the sum of the resistive element means equaling the impedance of the transmission line; and increasing the width of the series connection of resistive elements and intermediate tranmission line means from an end adapted for connection to the transmission line to an end adapted for connection to ground.

5. Zero frequency and higher frequency wide band apparatus for terminating a transmission line comprising, in combination:

ground means for connection to the ground portion of a transission line; and a plurality of serially connected resistive means and intermediate transmission line means connected to said ground means, each of said intermediate transmission line means having a nominal impedance equal to the total resistance of the remaining resistive means in said apparatus.

6. Zero frequency and higher frequency wide band apparatus for terminating a transmission line comprising, in combination:

ground means for connection to the ground portion of a transmission line; and a plurality of serially connected resistive means and intermediate transmission line means connected to said ground means, each of said intermediate transmission line means separating portions of said resistive means into increasingly wider resistive areas and correspondingly wide conductive transmission line means, the minimum distance of separation of said resistive areas being a direct function of resistance of adjacent resistive means and sufficient to dissipate heat generated by any signal currents flowing in adjacent resistive area portions of said resistive means.

7. The method of providing a wide band termination device for a transmission line while maintaining high power dissipation capability comprising, the steps of:

depositing a layer of resistive material on one surface side of a substrate having a ground plane on the opposite side for co-action with transmission line conductors, said resistive material increasing in width from an end to be connected to a transmission line to an end to be connected to said ground plane; and depositing conductive material on said resistive material whereby a termination means end product is obtained having transmission line areas, comprising both resistive and conductive material, separating consecutively wider resistive areas with the separation between solely resistive areas facilitating the amount of signal power dissipation from the adjacent resistive areas, the impedance of the transmission line means being substantially the same as the total resistance of the remaining resistive areas between a given transmission line area and said ground plane.

8. Apparatus for wide band terminating a planar transmission line while maintaining high power dissipation capability comprising, in combination:

substrate means including planar transmission line means to be terminated and ground plane means;

resistive material means attached to said substrate means between said transmission line means to be terminated and said ground plane means, said resistive material increasing in width from an end connected to said transmission line means to an end connected to said ground plane means; and a plurality of different length conductive material sections attached to said resistive material means for defining a plurality of trapezoidal shaped solely resistive areas with the length of the conductive material sections being a direct function of the resistance of adjacent resistive areas whereby a termination means end product is obtained having transmission line areas, comprising both resistive and conductive material, separating consecutively wider resistive areas.

9. Wide band apparatus for terminating a microstrip transmission line while maintaining high power dissipation capability comprising, in combination:

substrate means including microstrip transmission line means to be terminated and ground plane means;

resistive material means attached to said substrate means between said transmission line means to be terminated and said ground plane means, said resistive material increasing in width from an end connected to said transmission line means to an end connected to said ground plane means; and a plurality of conductive material sections attached to said resistive material means for defining a plurality of solely resistive areas whereby a termination means end product is obtained having transmission line areas, comprising both resistive and conductive material, separating consecutively wider resistance areas with the separation between solely resistive areas being related to the signal power dissipation of the adjacent resistive areas, the impedance of the transmission line means being substantially the same as the total resistance of the remaining resistive areas between a given transmission line means and said ground plane.

10. Transmission line terminating apparatus comprising, in combination:

substrate first means including first and second opposing surfaces with a ground plane means on said first surface;

second means on the second surface of said first means for conection to a transmission line to be terminated;

a plurality of successively wider resistive element third means on the second surface of said first means; and a plurality of transmission element fourth means interconnecting said third means on said second surface of said first means between said second means and said ground plane means, the length of each of said fourth means being a direct function of the heat generated by adjacent resistive element third means and being adapted for properly distributing the current flowing through said apparatus whereby there is a substantially uniform power density throughout any given resistive element third means.

11. Transmission line terminating apparatus comprising, in combination:

substrate first means including first and second opposing surfaces with a ground plane means on said first surface;

second means on the second surface of said first means for connection to a transmission line to be terminated;

a plurality of successively wider restrictive element third means on the second surface of said first means; and a plurality of transmission element fourth means interconnecting said third means on said second surface of said first means between said second means and said ground plane means, for spacing said third means in a direct relation to the resistance of said third means for maximizing dissipation of the power generated to said third means to said ground plane means without destroying adjacent resistive element means.

* * * * *